US009878460B2

(12) United States Patent
Omura

(10) Patent No.: US 9,878,460 B2
(45) Date of Patent: Jan. 30, 2018

(54) TABLET CUTTING BLADE REPLACEMENT JIG

(71) Applicant: TOSHO, INC., Tokyo (JP)

(72) Inventor: Yoshihito Omura, Tokyo (JP)

(73) Assignee: Tosho, Inc., Tokyo (JP)

( * ) Notice: Subject to any disclaimer, the term of this patent is extended or adjusted under 35 U.S.C. 154(b) by 18 days.

(21) Appl. No.: 14/915,788

(22) PCT Filed: Sep. 26, 2014

(86) PCT No.: PCT/JP2014/004933

§ 371 (c)(1),
(2) Date: Mar. 1, 2016

(87) PCT Pub. No.: WO2015/056411

PCT Pub. Date: Apr. 23, 2015

(65) Prior Publication Data

US 2016/0207215 A1 Jul. 21, 2016

(30) Foreign Application Priority Data

Oct. 18, 2013 (JP) ..... 2013-217016

(51) Int. Cl.
*B26D 7/26* (2006.01)
*A61J 7/00* (2006.01)
(Continued)

(52) U.S. Cl.
CPC ..... *B26D 7/2614* (2013.01); *A61J 7/0007* (2013.01); *B25B 11/02* (2013.01); *B26D 1/08* (2013.01); *B26D 3/30* (2013.01)

(58) Field of Classification Search
USPC ..... 29/283
See application file for complete search history.

(56) References Cited

U.S. PATENT DOCUMENTS 8,707,565 B2 * 4/2014 Muccino ..... B26B 5/001 30/125
2009/0031872 A1 * 2/2009 Lykam ..... A61J 3/06 83/78

(Continued)

FOREIGN PATENT DOCUMENTS

JP 2001-61945 A 3/2001
JP 2013-39237 A 2/2013

(Continued)

*Primary Examiner* — George Nguyen
(74) *Attorney, Agent, or Firm* — Birch, Stewart, Kolasch & Birch, LLP

(57) ABSTRACT

Attachment/detachment of tablet cutting blades to/from a tablet cutting blade replacement jig inserted into and withdrawn from a tablet splitting apparatus to receive and deliver the tablet cutting blades is facilitated even in a dispensing site. The cutting edges of the tablet cutting blades are allowed to be exposed without detaching the tablet cutting blades. The tablet cutting blade replacement jig (60) includes: a jig main body (61) that can be inserted into and withdrawn from support members (28) in place of a falling tablet guiding member; blade holders (64) for retaining tablet cutting blades (41) within notches (63) of the jig main body (61); operating members (72) that are manually operated to switch between maintenance and release of retention of the tablet cutting blades; and urging members for maintaining the switched state even though the switched state is on a retention maintained side or is on a retention released side. Two openable-closable plate-shaped bodies (61*a* and 61*b*) are disposed in the jig main body (61), and the tablet cutting blades (41) are held with their cutting edges oriented toward inward surfaces of the two plate-shaped bodies (61*a* and 61*b*) in a closed state.

4 Claims, 10 Drawing Sheets

(51) Int. Cl.

| | |
|---|---|
| ***B26D 3/30*** | (2006.01) |
| ***B26D 1/08*** | (2006.01) |
| ***B25B 11/02*** | (2006.01) |

(56) References Cited

U.S. PATENT DOCUMENTS

| | | | | |
|---|---|---|---|---|
| 2009/0106909 | A1* | 4/2009 | Tyers | B25F 1/00 7/118 |
| 2009/0179095 | A1* | 7/2009 | Hurst | A61J 7/0007 241/30 |
| 2011/0271530 | A1* | 11/2011 | Raghuprasad | B26D 3/30 30/124 |
| 2012/0192434 | A1* | 8/2012 | Syrjala | B26B 1/08 30/162 |
| 2013/0125722 | A1 | 5/2013 | Omura et al. | |
| 2014/0174271 | A1 | 6/2014 | Omura et al. | |

FOREIGN PATENT DOCUMENTS

| | | | |
|---|---|---|---|
| WO | WO 2012/014533 | A1 | 2/2012 |
| WO | WO 2013/024903 | A1 | 2/2013 |

* cited by examiner

TABLET CUTTING BLADE REPLACEMENT JIG

TECHNICAL FIELD

This invention relates to a jig used to, for example, replace tablet cutting blades of a tablet splitting apparatus in which a tablet is cut by the tablet cutting blades to split it into several cut tablet pieces. Particularly, the invention relates to a tablet cutting blade replacement jig temporarily attached to and detached from the tablet splitting apparatus to receive or deliver the tablet cutting blades.

BACKGROUND ART

A tablet splitting apparatus and a tablet cutting blade replacement jig are known, which are configured to allow simple and easy attachment and detachment of tablet cutting blades (see, for example, PTL 1). In order to cut a tablet, this conventional tablet splitting apparatus includes: a falling tablet guiding member formed from a plate-shaped body and having a groove-shaped tablet falling path extending from its upper end to its lower end; receiving members that temporarily hold a tablet falling through the tablet falling path and to be split when the path is closed and opened, the tablet being held at a cutting position partway down the tablet falling path; a cutting mechanism for cutting the tablet by moving blade moving members with tablet cutting blades attached thereto toward the cutting position; and a housing that accommodates the falling tablet guiding member, the receiving members, and the cutting mechanism.

In this tablet splitting apparatus, an opening through which the falling tablet guiding member and the tablet cutting blades can pass is formed in the housing in order to facilitate attachment and detachment of the tablet cutting blades. Engaging edges of support members that are engaged with the falling tablet guiding member to support the falling tablet guiding member are formed immediately inside the opening. In the above tablet splitting apparatus, the falling tablet guiding member is attached to or detached from the tablet splitting apparatus by sliding the falling tablet guiding member while it is engaged with the support members to thereby insert the falling tablet guiding member into the housing through the opening or withdraw the falling tablet guiding member from the housing through the opening.

The tablet cutting blades are slidingly engaged with and disengaged from the blade moving members, and the opening is located ahead of the blade moving members in the direction of sliding.

The tablet cutting blades are inserted into the housing through the opening and then slidingly engaged with the blade moving members. The sliding direction of the falling tablet guiding member is parallel to the sliding direction of the blades.

The tablet cutting blade replacement jig is temporarily inserted into and withdrawn from, i.e., attached to and detached from, the support members in place of the falling tablet guiding member when the tablet cutting blades are attached to or detached from the blade moving members. An attachment jig for attaching the tablet cutting blades to the tablet splitting apparatus and a detachment jig for detaching the tablet cutting blades from the tablet splitting apparatus are collectively referred to as tablet cutting blade replacement jigs. Each of the attachment jig and the detachment jig includes: a plate-shaped jig main body that can be slidingly engaged with and disengaged from the support members in place of the falling tablet guiding member; and blade holders that are attached to the jig main body and can hold the tablet cutting blades. When the jig main body is engaged with the support members, the detachment jig is in a capture state in which the tablet cutting blades attached to the blade moving members are captured by the blade holders. In the capture state, when the jig main body is disengaged from the support members, the tablet cutting blades are detached from the blade moving members.

When the jig main body is engaged with the support members with the tablet cutting blades held by the blade holders, the attachment jig assumes an attachment state in which the tablet cutting blades are engaged with and attached to the blade moving members. When the jig main body in the attachment state is disengaged from the support members, the blades are detached from the blade holders.

The use of these two tablet cutting blade replacement jigs allows, for example, replacement of the tablet cutting blades of the tablet splitting apparatus to be performed simply, easily, and safely by insertion and withdrawal of the plate-shaped body that is easier to hand-hold than the tablet cutting blades.

CITATION LIST

Patent Literature

PTL 1: Japanese Unexamined Patent Application Publication No. 2013-039237

SUMMARY OF INVENTION

Technical Problem

The conventional tablet cutting blade replacement jigs include two special-purpose jigs, i.e., the attachment jig and the detachment jig are used. These jigs need to be prepared in advance before the replacement of the tablet cutting blades, and the preparation work itself for the blades is troublesome. For these jigs, importance is given to attachment/detachment of the tablet cutting blades to/from the tablet splitting apparatus when the tablet cutting blade replacement jig is inserted into and withdrawn from the tablet splitting apparatus. Although the replacement work of the tablet cutting blades is facilitated, no consideration is given to attachment/detachment of the tablet cutting blades to/from the tablet cutting blade replacement jig. Therefore, in a dispensing site with no attachment/detachment assisting device that allows the tablet cutting blades to be simply and safely attached to and detached from the tablet cutting blade replacement jig, it is not easy to re-attach the tablet cutting blades that have been temporarily detached from the tablet splitting apparatus in order to, for example, check the condition of the cutting edges of the blades.

Accordingly, a first technical object is to realize a tablet cutting blade replacement jig that allows easy attachment/detachment of tablet cutting blades to/from the tablet cutting blade replacement jig even in a dispensing site.

In the conventional tablet cutting blade replacement jig, a slit is formed in the plate-shaped jig main body, and the cutting edges of the tablet cutting blades are accommodated in the slit. Therefore, for example, to check the condition of the cutting edges or to clean the cutting edges, it is necessary to disengage the tablet cutting blades from the tablet cutting blade replacement jig. This issue could be improved by allowing the tablet cutting blades to be easily attached to and detached from the tablet cutting blade replacement jig even in a dispensing site.

However, the operations such as inspection of the condition of the cutting edges and cleaning of the cutting edges can be performed more easily and also more safely with the tablet cutting blades attached to the large, easy-to-hold tablet cutting blade replacement jig than with the small, difficult-to-hold tablet cutting blades held directly by hand, so long as their cutting edges are exposed.

Accordingly, a second technical object is to realize a tablet cutting blade replacement jig that allows the cutting edges to be exposed without detaching the tablet cutting blades.

Solution to Problem

A tablet cutting blade replacement jig of the present invention (solution 1) has been devised to achieve the first technical object described above. The tablet cutting blade replacement jig is used to assist a tablet cutting blade attaching/detaching operation for a tablet splitting apparatus. The tablet splitting apparatus is configured to allow a plate-shaped falling tablet guiding member having a tablet falling path formed therein to be slidingly engaged with and disengaged from a support member for the falling tablet guiding member and to allow tablet cutting blades to be slidingly engaged with and disengaged from blade moving members for holding the tablet cutting blades with a direction of sliding of the tablet cutting blades being parallel to a direction of sliding of the falling tablet guiding member. The tablet splitting apparatus includes a housing that accommodates the support member and the blade moving members. The housing has an opening that allows the falling tablet guiding member and the tablet cutting blades to pass therethrough simultaneously, and the opening is formed ahead of the support member and the blade moving members in the directions of sliding. The tablet cutting blade replacement jig comprises: a jig main body including at least one plate-shaped body having a notch that is formed so as to allow the tablet cutting blades to be inserted thereinto with the tablet cutting blades being slidable with respect to the blade moving members, the jig main body being capable of being slidingly engaged with and disengaged from the support member in place of the falling tablet guiding member; blade holders for retaining the tablet cutting blades within the notch; operating members that are manually operated to switch between maintenance and release of retention of the tablet cutting blades; and urging members for maintaining a state after switching even though the state is on a retention maintained side or is on a retention released side.

A tablet cutting blade replacement jig of the present invention (solution 2) has been devised to achieve the second technical object in addition to the first technical object described above and is the tablet cutting blade replacement jig according to solution 1 above, wherein the at least one plate-shaped body comprises two plate-shaped bodies that are disposed in the jig main body so as to be openable and closable, and the tablet cutting blades are held in the plate-shaped bodies with cutting edges of the tablet cutting blades oriented toward inward surfaces of the two plate-shaped bodies in a closed state.

A tablet cutting blade replacement jig of the present invention (solution 3) has been devised to achieve the first technical object described above and comprises: a holder for holding a cutting member including a blade that moves into and out of a falling path for a tablet and cuts the tablet when the blade enters the falling path; an attachment-detachment portion attached to and detached from a support member in place of a tablet guiding member that forms the falling path, the tablet guiding member being configured to slide along the support member when the tablet guiding member is attached to and detached from a main body of a tablet splitting apparatus; and an operating member for setting one of a retention maintained state in which a holding state where the cutting member is held in the holder is maintained and a retention released state in which the holding state is releasable; wherein the attachment-detachment portion slides along the support member in a direction parallel to a direction of sliding of the tablet guiding member along the support member and is thereby attached to and detached from the support member, wherein the holder receives and releases the cutting member in the direction parallel to the direction of sliding of the tablet guiding member; wherein, by attaching the attachment-detachment portion to the support member while the holding state is maintained, setting the retention released state using the operating member, and then detaching the attachment-detachment portion from the support member, the cutting member is attached to the main body of the tablet splitting apparatus, and wherein, by attaching the attachment-detachment portion to the support member, setting the retention maintained state using the operating member while the holding state is maintained, and then detaching the attachment-detachment portion from the support member, the cutting member is detached from the main body of the tablet splitting apparatus.

A tablet cutting blade replacement jig of the present invention (solution 4) has been devised to achieve the second technical object in addition to the first technical object described above and is the tablet cutting blade replacement jig according to solution 3 above. This tablet cutting blade replacement jig further comprises an urging member that allows the retention maintained state to be maintained unchanged and the retention released state to be maintained unchanged.

Advantageous Effects of Invention

When the above-described tablet cutting blade replacement jig of the present invention (solution 1) is used, the jig is inserted into and withdrawn from the tablet splitting apparatus from which the falling tablet guiding member has been temporarily withdrawn for, for example, replacement of the tablet cutting blades of the tablet splitting apparatus. The state of the tablet cutting blade replacement jig can be easily switched manually even when the tablet cutting blades are retained in the jig main body and also when the retention is released. After the manual operation, the tablet cutting blade replacement jig is urged to the retention maintained side or the retention released side, and the switched state is maintained in a bistable state. This allows not only delivery of the tablet cutting blades between the tablet cutting blade replacement jig and the tablet splitting apparatus but also attachment/detachment of the tablet cutting blades to/from the tablet cutting blade replacement jig to be performed easily even in a dispensing site by manually switching the retention states of the tablet cutting blades. In addition, to perform these operations, it is possible to freely select whether different tablet cutting blade replacement jigs or a single tablet cutting blade replacement jig is used for attachment and detachment of the tablet cutting blades.

Therefore, according to this invention, a tablet cutting blade replacement jig can be realized, which allows tablet cutting blades to be easily attached thereto and detached therefrom even in a dispensing site. This tablet cutting blade replacement jig can be used for both attachment and detachment of the tablet cutting blades.

In the tablet cutting blade replacement jig of the present invention (solution 2), when the two plate-shaped bodies are closed, the cutting edges of the tablet cutting blades are hidden in a place at inward surfaces of the plate-shaped bodies, which are their mating surfaces. This allows the cutting edges of the tablet cutting blades to resist stains, and the jig main body with the tablet cutting blades attached thereto can be handled safely. When the two plate-shaped bodies are opened, the mating surfaces of the plate-shaped bodies, i.e., their inward surfaces in the closed state, are exposed, and the cutting edges of the tablet cutting blades are thereby exposed. Therefore, the cutting edges of the tablet cutting blades can be exposed without removing the tablet cutting blades from the jig main body. In addition, in this case, by simply holding the operating members in the retention maintained state, the tablet cutting blades remain retained in the plate-shaped bodies. Therefore, by hand-holding the jig main body that is larger than the tablet cutting blades and conforms to the hand, for example, inspection of the condition of the cutting edges of the tablet cutting blades and cleaning of the cutting edges of the tablet cutting blades can be performed easily and safely.

In the tablet cutting blade replacement jig of the present invention (solution 3), its state can be easily switched manually even when the cutting member is retained in the holder and also when the retention is released. Therefore, a tablet cutting blade replacement jig that allows the tablet cutting blades to be easily attached thereto and detached therefrom even in a dispensing site can be realized.

In the tablet cutting blade replacement jig of the present invention (solution 4), its state can be easily switched manually even when the cutting member is retained in the holder and also when the retention is released. After the manual operation, the tablet cutting blade replacement jig is urged in a direction in which the retention maintained state or the retention released state is maintained, and the switched state is maintained stably.

DESCRIPTION OF EMBODIMENTS

Figure 1:
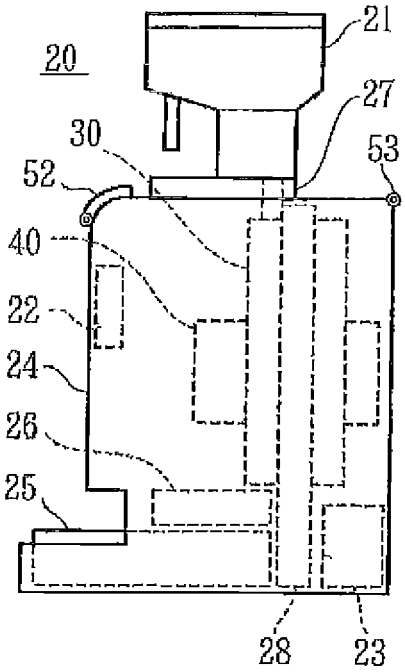
FIG. 1 is a side view illustrating the structure of a tablet splitting apparatus, which is an exemplary embodiment of the present invention.

Specific exemplary embodiments of the tablet cutting blade replacement jig of the present invention will be described with reference to the drawings.

In the drawings, illustrations of the details of fasteners such as bolts, driving sources such as electric motors, transmission members such as gears, electric circuits such as motor drivers, and electronic circuits such as controllers are omitted for simplification etc., and components necessary for or relevant to the description of the present invention are mainly shown.

First, a description will be given of a tablet splitting apparatus 20 and tablet cutting blades 41 for which the tablet cutting blade replacement jig of the present invention is used. This is because the tablet splitting apparatus 20 and the tablet cutting blades 41 are closely related to the tablet cutting blade replacement jig of the present invention.

As shown in FIG. 1, the tablet splitting apparatus 20 includes, as basic components responsible for the tablet splitting function of the apparatus itself, a tablet cassette 21, an operating unit 22, a control unit 23, a main body 24, a receiving unit 25, a transit unit 26, a tablet feeder base 27, support members 28, a holding mechanism 30, a cutting mechanism 40, and an unillustrated power source unit. The control unit 23, the transit unit 26, the support members 28, the holding mechanism 30, the cutting mechanism 40, and the power source unit are contained in a housing of the main body 24. The operating unit 22 and the tablet feeder base 27 are fixedly attached to the main body 24, and an operating panel of the operating unit 22 and a cassette attachment surface of the tablet feeder base 27 are exposed to the outside of the housing. The tablet cassette 21 is detachably attached to the tablet feeder base 27, and the receiving unit 25 is inserted into the main body 24 so as to be capable of being drawn out through a front opening in a bottom portion of the main body 24.

Figure 2:
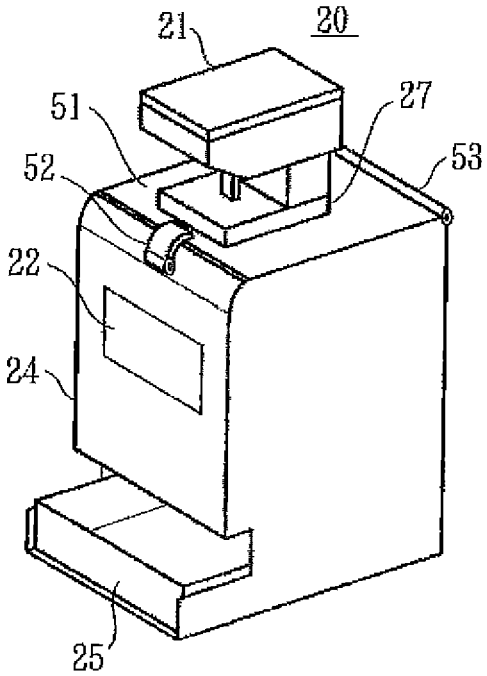
FIG. 2 is an external perspective view of the tablet splitting apparatus shown in FIG. 1.

As shown in FIG. 1 or 2, the main body 24 includes the tablet feeder base 27 fixedly disposed on an uppermost lid 51, the support members 28 that are fixedly disposed at a central portion, with respect to a front-rear direction, of the housing so as to assume an upright posture, and the transit unit 26 fixedly disposed frontward of lower portions of the support members 28 within the housing. The receiving unit 25 disposed below the transit unit 26 can be taken in and out of the housing.

In a central portion of the housing of the main body 24, the holding mechanism 30 and the cutting mechanism 40 are attached to the support members 28 or other support members. The holding mechanism 30 assumes the same upright posture as that of the support members 28, and the cutting mechanism 40 assumes a horizontal posture perpendicular to the holding mechanism 30.

Figure 3:
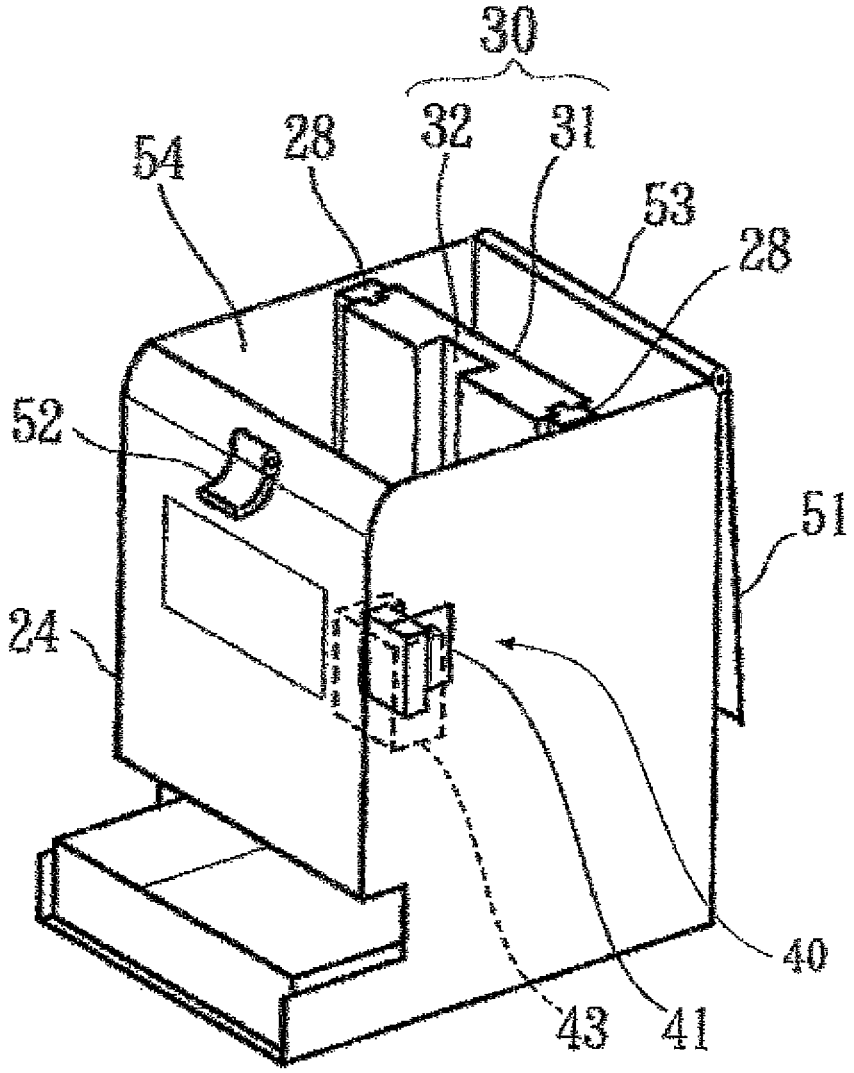
FIG. 3 is an external perspective view of the tablet splitting apparatus shown in FIG. 1 with an opening opened.

As shown in FIG. 3, the lid 51 at the upper end of the housing of the main body 24 is an openable top plate. The lid 51 is in a closed state when a tablet is split and is in an opened state when, for example, one of or both the two tablet cutting blades 41 and 41, i.e., opposed blades 41 and 41 opposed to each other with their cutting edges close to each other, are replaced or the cutting edges are checked and cleaned. To achieve the opened state of the lid 51, a lock 52 is released, and the lid 51 is rotated backward about a hinge 53, whereby an opening 54 appears. The opening 54 occupies most of the upper end surface of the main body 24 and is large enough to allow not only a guiding member 31, i.e., a falling tablet guiding member of the holding mechanism 30 described later, and the opposed blades 41 and 41 of the cutting mechanism 40 to pass separately therethrough but also the guiding member 31 together with the opposed blades 41 and 41 to be taken in and out of the housing of the main body 24 through the opening 54.

Figure 4:
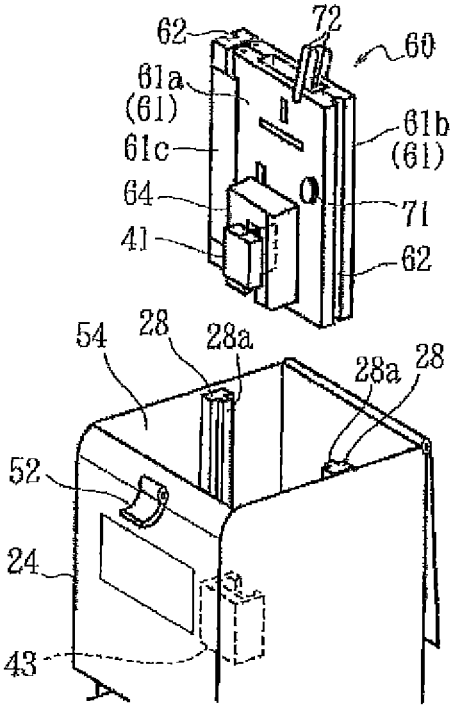
FIG. 4 is an external perspective view of the tablet splitting apparatus shown in FIG. 1 and a tablet cutting blade replacement jig.

As shown in FIG. 3 or 4, the support members 28 are two pillar-shaped members. These pillar-shaped members are disposed so as to assume an upright posture, extend from the inner bottom of the housing of the main body 24 to its top portion, and are arranged laterally parallel to each other such that their protrusions 28*a* protrude inward from facing surfaces of the pillar-shaped members. When the lid 51 is opened, the upper ends of the support members 28 appear immediately below the opening 54. The protrusions 28*a* can be attached to and detached from, i.e., slidingly engaged with and disengaged from, recesses 38 of the guiding member 31 of the holding mechanism 30 described later and also recesses 62 of a jig main body 61 of a blade replacement jig 60, which is the tablet cutting blade replacement jig described later. Specifically, the protrusions 28*a* are sliding engagement portions which serve as sliding portions and also as engagement portions. The protrusions 28*a* are formed so as to extend from the upper ends of the support members 28 to their lower ends. The protrusions 28*a* may be formed so as to extend from the upper ends of the support members 28 to near their lower ends.

The support members 28 having the protrusions 28*a* are disposed such that engaging edges between the protrusions 28*a* and the recesses 38 are located immediately inward of the opening 54.

The tablet feeder base 27 and the tablet cassette 21 attached thereto are used to automatically supply tablets 10 sequentially. When a driving motor of the tablet feeder base 27 is operated under the control of the control unit 23, the tablets 10 are discharged one by one from the tablet cassette 21 attached to the base plate. Each of the discharged tablets 10 is fed to an upstream path of a tablet falling path 32 of the holding mechanism 30 from the upper end of the upstream path through guides such as an introduction port and a duct.

Figure 5:
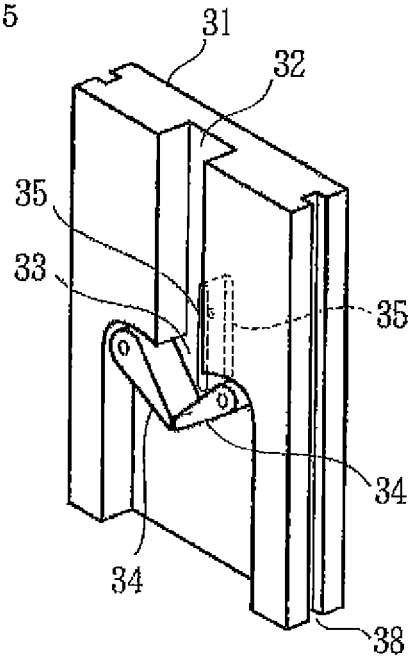
FIG. 5 is an external perspective view of a falling tablet guiding member to be attached inside the tablet splitting apparatus.
Figure 6:
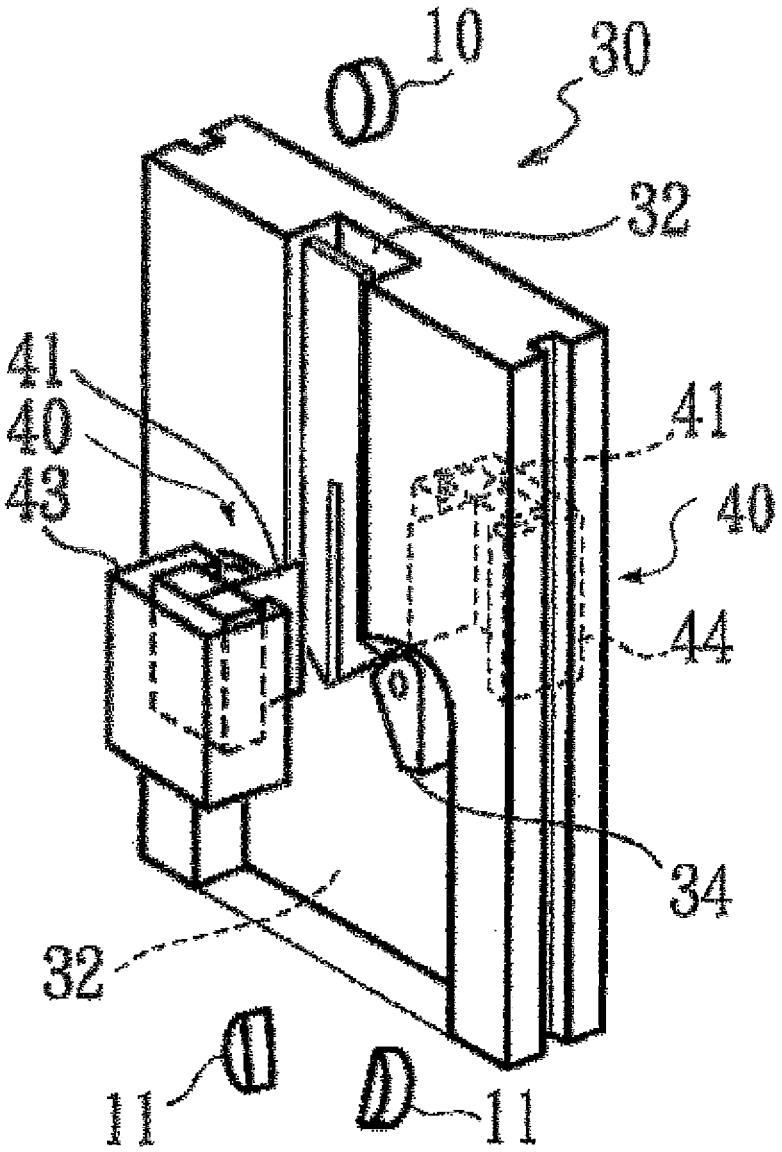
FIG. 6 is an external perspective view of the falling tablet guiding member shown in FIG. 5 and a cutting mechanism.

As shown in FIG. 5, the holding mechanism 30 has the tablet falling path 32 which is a falling path of the tablets 10, receiving members 34 that temporarily hold, at a cutting position 33, a tablet 10 entering the upstream portion of the tablet falling path 32, and a slit 35. A tablet 10 to be split falls from the tablet cassette 21 through the tablet feeder base 27 and the guides and enters the upstream portion of the tablet falling path 32, and the receiving members 34 temporarily hold this tablet 10 at the cutting position 33. As shown in FIG. 6, the cutting mechanism 40, which is a cutting member including the tablet cutting blades 41 for cutting the tablet 10, cuts the tablet 10 held at the cutting position 33 into two pieces 11 and 11, i.e., cut tablet pieces, at a position of the slit 35.

The transit unit 26 includes a collection guide and a cushioning buffer. The transit unit 26 delivers the cut tablet pieces 11 falling from the downstream portion of the tablet falling path 32 of the holding mechanism 30 to the receiving unit 25.

The receiving unit 25 is a rectangular box-shaped or rectangular dish-shaped container for receiving and storing the pieces 11 and 11 obtained by splitting the tablet 10.

The receiving unit 25, the transit unit 26 that guides the pieces 11 and 11 to the receiving unit 25, the operating unit 22, and the control unit 23 are disposed integrally with the apparatus in order to, for example, facilitate transportation of the apparatus. The receiving unit 25, the transit unit 26, the operating unit 22, and the control unit 23 may be independent units separable from the main body 24 or may be provided separated from the apparatus.

The holding mechanism 30 includes the plate-shaped guiding member 31 disposed between the tablet feeder base 27 and the transit unit 26 and a pair of receiving members 34 that are movable members each having a swingable lower end and an upper end serving as a pivot.

The holding mechanism 30 forms a tablet holding state in which the receiving members 34 are used to trap a tablet 10 to be split at the cutting position 33 partway down the tablet falling path 32 so that the cutting mechanism 40 can cut the tablet 10 as described above. The holding mechanism 30 may cooperate with the cutting mechanism 40 to release the tablet holding state formed by the holding mechanism 30. The receiving members 34 are accommodated in the tablet falling path 32 and attached to the guiding member 31 in order to open/close the tablet falling path 32.

Figure 7:
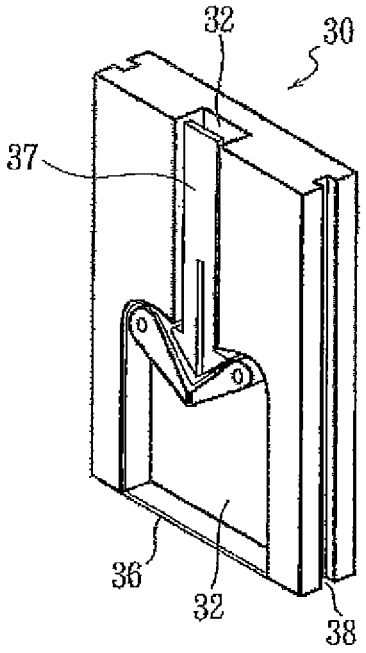
FIG. 7 is an external perspective view of the falling tablet guiding member shown in FIG. 5 and a holding mechanism.

As shown in FIG. 7, the holding mechanism 30 has, in order to adjust the posture and orientation of a tablet 10 falling through the upstream portion of the tablet falling path 32: a guiding plate 37 which is a groove depth defining member inserted into the upstream portion of the tablet falling path 32 to cover the upstream portion of the tablet falling path 32; and an unillustrated thickness adjusting mechanism for adjusting the thickness of the tablet falling path 32 by moving the guiding plate 37. The holding mechanism 30 has a fixed cover plate 36 that covers the lower half of the front surface, i.e., the forward surface, of the guiding member 31, in order to prevent the pieces 11 and 11 from falling off the downstream portion of the tablet falling path 32. In FIG. 7, the fixed cover plate 36 is shown as a transparent member such that the tablet falling path 32 can be see through the transparent member.

Figure 8:
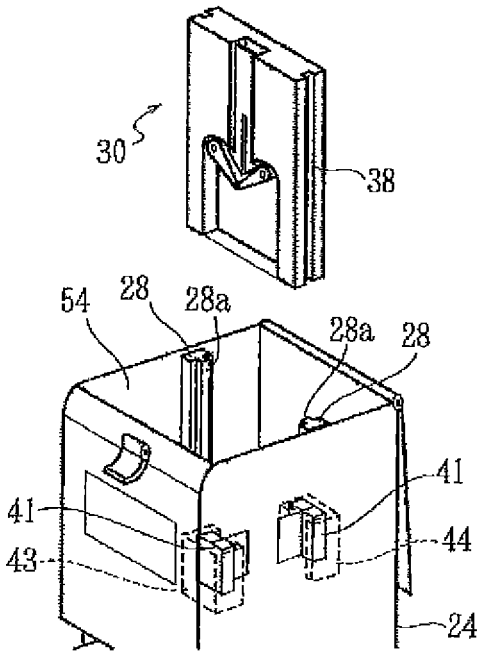
FIG. 8 is an external perspective view showing a state in which the holding mechanism has been detached from or is to be attached to a main body using the falling tablet guiding member shown in FIG. 5.

The guiding member 31 is a relatively thick vertical plate body. When the guiding member 31 is inserted into the main body 24 through the opening 54 with the lower ends of the recesses 38 on the left and right end surfaces of the guiding member 31 aligned with the upper ends of the protrusions 28*a* of the support members 28 as shown in FIG. 8, the guiding member 31 slides while engaged with the support members 28. The guiding member 31 slides while the recesses 38 are engaged with the protrusions 28*a* as described above, reaches the lower ends of the protrusions 28*a* or near the lower ends, and is thereby fixed inside the main body 24 so as to assume a vertical state in which the guiding member 31 is substantially parallel to a front plate and a rear surface of the main body 24.

The guiding member 31 is slidingly engaged with and disengaged from the support members 28 that support the guiding member 31 within the housing of the main body 24 and is thereby attached to and detached from the main body 24. In other words, while the guiding member 31 is inserted into the housing of the main body 24 through the opening 54, the guiding member 31 can be slidingly engaged with the support members 28.

Among opposite surfaces (front and rear surfaces, i.e., forward and rearward surfaces) of the guiding member 31, the forward surface has formed thereon the tablet falling path 32 for guiding a falling tablet 10.

The tablet falling path 32 is a groove which is a groove portion formed on the front surface of the guiding member 31 by, for example, engraving or pressing and extends from the upper end of the guiding member 31 to its lower end. At the cutting position 33 located partway down the tablet falling path 32, the slit 35 through which the cutting edges of the cutting mechanism 40 pass is formed so as to pierce the guiding member 31.

In the tablet falling path 32, a portion upstream of the cutting position 33 is relatively narrow because it is only necessary to allow non-split tablets 10 to pass therethrough one by one, but a downstream portion of the tablet falling path 32 includes a large-width path having an increased width that is formed immediately below the cutting position 33, more specifically immediately below the slit 35 at the center of the cutting position 33.

The receiving members 34 include a lateral pair of receiving members and are disposed in the large-width path immediately below the cutting position 33. The receiving members 34 swing under the control of the control unit 23 to open/close the tablet falling path 32 at a position immediately below the cutting position 33.

The tablet splitting apparatus 20 is used to split a disk-shaped tablet 10 into equal left and right halves. Therefore, the tablet splitting apparatus 20 has the slit 35 that pierces the guiding member 31 in the front-rear direction. The slit 35 is provided to allow the cutting edges of the blades of the cutting mechanism 40 to pass therethrough and is formed vertically at the center of the cutting position 33. When a tablet 10 is split, the receiving members 34 close the tablet falling path 32 to temporarily hold the tablet 10 falling through the upstream portion of the tablet falling path 32 at the cutting position 33 located partway down the tablet falling path 32. Therefore, the pair of receiving members 34 are disposed left-right symmetrically about the slit 35.

The pair of receiving members 34 assume a V shape with their lower ends close to each other when a tablet 10 is temporarily held at the cutting position 33, and the tablet falling path 32 is thereby closed at a position immediately below the cutting position 33 and the slit 35 to form the tablet holding state. When pieces 11 and 11 obtained by splitting the tablet 10 are caused to fall, the pair of receiving members 34 swing simultaneously toward their open sides to release the tablet holding state.

The cutting mechanism 40 includes the opposed blades 41 and 41 for cutting that include a front (forward) tablet cutting blade 41 and a rear (rearward) tablet cutting blade 41 that move toward and away from the cutting position 33. The opposed blades 41 and 41 move such that their cutting edges come close to each other and also move such that their cutting edges are separated from each other, whereby the gap between the opposed blades 41 and 41 is increased and reduced. In the tablet holding state, the opposed blades 41 and 41 hold a tablet 10 therebetween in the front-rear direction at the cutting position 33 and then cut the tablet 10 to split it into equal left and right pieces 11 and 11. The front tablet cutting blade 41 is supported by the front blade moving member 43 at a position in front of the slit 35 provided at the cutting position 33, and the front blade moving member 43 is a reciprocally movable blade moving member attached to an unillustrated rigid gate-shaped support mechanism of a rod-sleeve fitted type. The front tablet cutting blade 41 is configured to move rearward toward the slit 35 under the control of the control unit 23. The rear tablet cutting blade 41 is supported by the rear blade moving member 44, which is a reciprocally movable blade moving member disposed on the rear side of the guiding member 31. The rear tablet cutting blade 41 is configured to pass through the slit 35 and move forward toward a tablet 10 held at the cutting position 33 under the control of the control unit 23.

Figure 9:
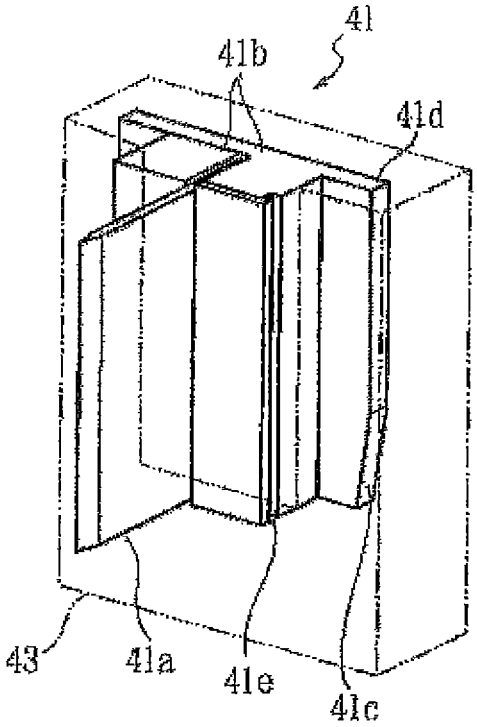
FIG. 9 is an external perspective view of a tablet cutting blade, showing the structure of the tablet cutting blade that is to be attached to and detached from the tablet splitting apparatus using the tablet cutting blade replacement jig.
Figure 10:
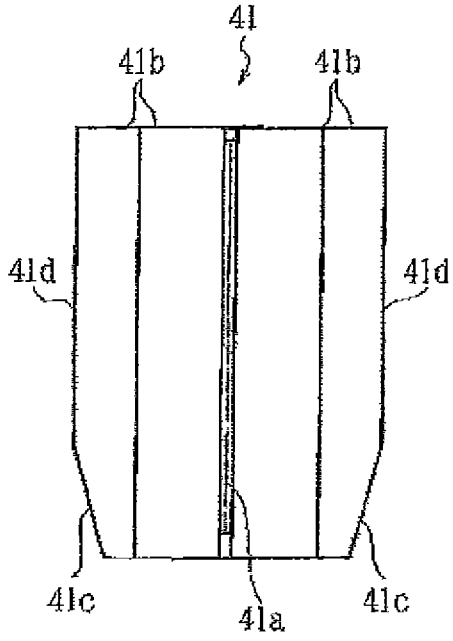
FIG. 10 is a front view of the tablet cutting blade shown in FIG. 9.
Figure 11:
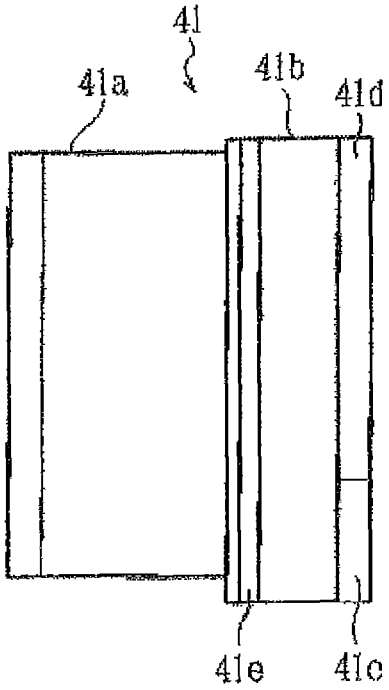
FIG. 11 is a right side view of the tablet cutting blade shown in FIG. 9.
Figure 12:
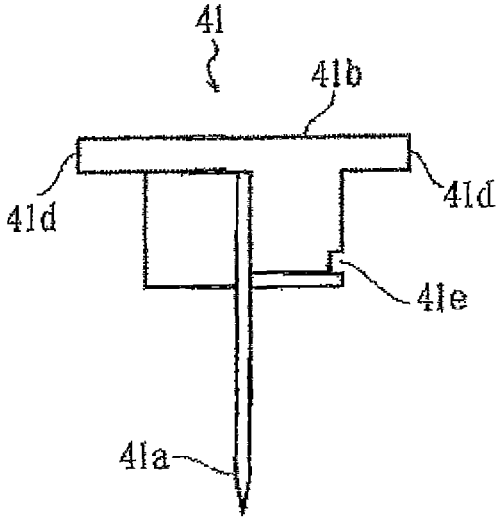
FIG. 12 is a plan view of the tablet cutting blade shown in FIG. 9.

As shown in FIGS. 9 to 11, each of the tablet cutting blades 41 has a cutting edge portion 41*a* for cutting a tablet 10 and a blade base 41*b* for attaching the cutting edge portion 41*a* to the blade moving member 43 or 44. Each blade base 41*b* has a tapered portion 41*c* formed in a lower end portion thereof and protrusions 41*d* formed on opposite lateral sides and extending vertically.

When the lower ends of the protrusions 41*d* are aligned with the upper ends of the recesses of the blade moving member 43 or 44 and the tablet cutting blade 41 is moved straight down with this posture maintained, the tablet cutting blade 41 is slidingly engaged with the blade moving member 43 or 44. Suppose that the blade moving member 43 or 44 is fixed, and then, when the tablet cutting blade 41 engaged with the blade moving member 43 or 44 is moved straight up with the posture of the tablet cutting blade 41 maintained, the tablet cutting blade 41 is slidingly disengaged from the blade moving member 43 or 44.

Each blade base 41*b* has a vertically extending recess 41*e* formed in a portion that is exposed when the blade base 41*b* is attached to the blade moving member 43 or 44. The recess 41*e* is a temporary holding engagement portion. Specifically, when a protrusion 66 of a blade holder 64 of the blade replacement jig 60 described later is fitted into the recess 41*e*, the recess 41*e* is engaged with the protrusion 66. Similarly, the recess 41*e* is a temporary holding sliding portion. Specifically, when the protrusion 66 of the blade holder 64 of the blade replacement jig 60 is fitted into the recess 41*e*, the recess 41*e* and the protrusion 66 slide along each other. As described above, the blade replacement jig 60 and each of the tablet cutting blades 41 can be slidingly joined to each other and separated from each other. Specifically, the tablet cutting blades 41 are slidingly joined to and separated from the blade moving members 43 and 44 and also the blade replacement jig 60.

The sliding direction of one tablet cutting blade 41 with respect to the front blade moving member 43 and the sliding direction of the other tablet cutting blade 41 with respect to the rear blade moving member 44 are parallel to the sliding direction of the guiding member 31 with respect to the support members 28. The opening 54 is located ahead of these members in these three directions. Therefore, only one of the tablet cutting blades 41, both the opposed blades 41 and 41, i.e., the two tablet cutting blades 41 and 41, or the opposed blades 41 and 41 together with the blade replacement jig 60 in place of the guiding member 31 can be inserted into the housing of the main body 24 through the opening 54 to allow the tablet cutting blades 41 and 41 to be slidingly engaged with the blade moving members 43 and 44. Similarly, the reverse operation, i.e., removal of these members to the outside of the housing through the opening 54, can be performed through the opening 54 in various manners.

The control unit 23 is an electronic control unit including, for example, a programmable microprocessor system or a programmable sequencer. In order to appropriately supply and cut tablets 10 sequentially, the control unit 23 is configured to control the operation of, for example, electric motors of the tablet feeder base 27, the holding mechanism 30, and the cutting mechanism 40 so that they can cooperate with each other.

The control unit 23 adapts the position of the guiding plate 37 to the thickness of a tablet 10 according to pre-acquired data about the thickness of the tablet 10 or the falling condition of the falling tablet 10.

The detailed illustration of the control unit 23 is omitted.

The blade replacement jig 60 is used to attach/detach the opposed blades 41 and 41 to/from the blade moving members 43 and 44 in the housing of the main body 24 of the tablet splitting apparatus 20.

Figure 13:
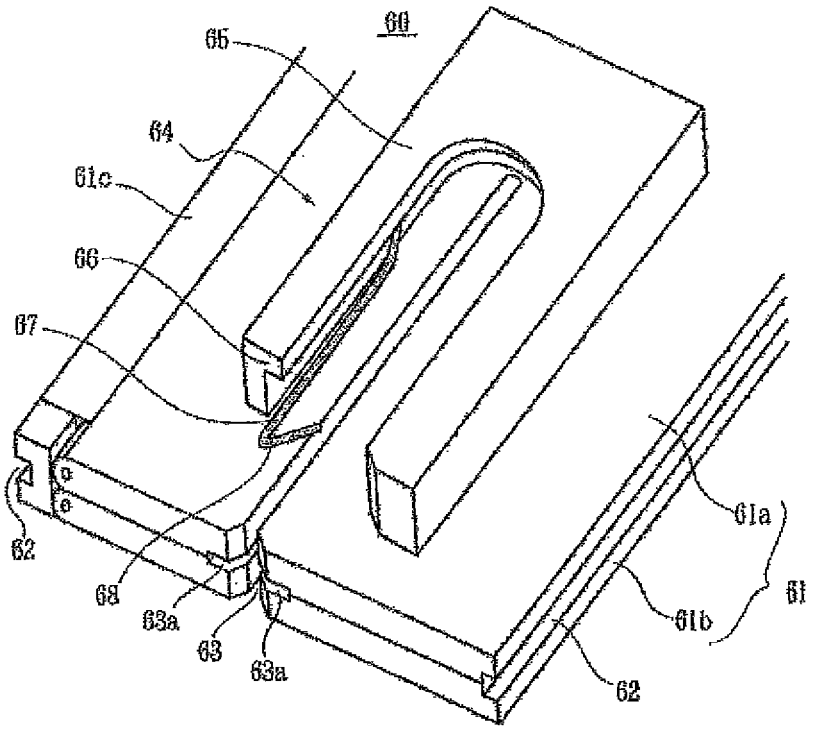
FIG. 13 is an illustration showing the structure of the tablet cutting blade replacement jig shown in FIG. 4.
Figure 14:
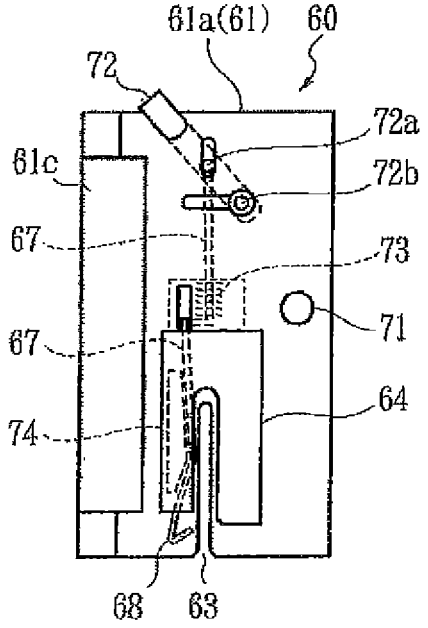
FIG. 14 is a front view showing a retention released state of the tablet cutting blade replacement jig shown in FIG. 4.

As shown in FIGS. 13 and 14, the blade replacement jig 60 includes a plate-shaped jig main body 61 having the same width as the guiding member 31, blade holders 64 attached to the jig main body 61, a locking screw 71, operating members 72, urging members 73, and guides 74.

Recesses 62 similar to the recesses 38 of the guiding member 31 described above are formed on the opposite lateral edges of the jig main body 61. Therefore, the recesses 62 serving as attachment-detachment portions of the jig main body 61 can be slidingly engaged with and disengaged from the support members 28 in place of the guiding member 31.

Figure 15:
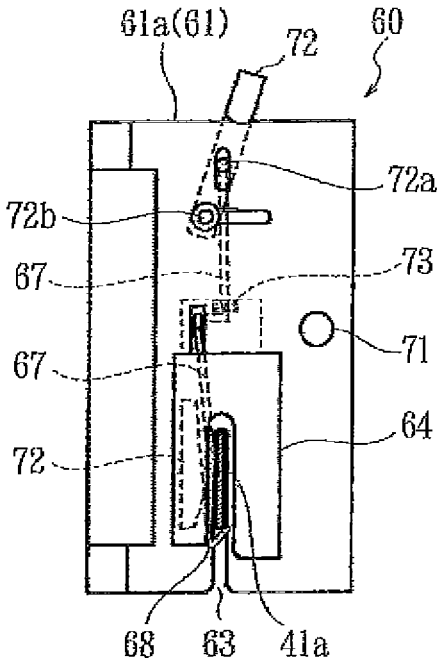
FIG. 15 is a front view showing a retention maintained state of the tablet cutting blade replacement jig shown in FIG. 4.
Figure 16:
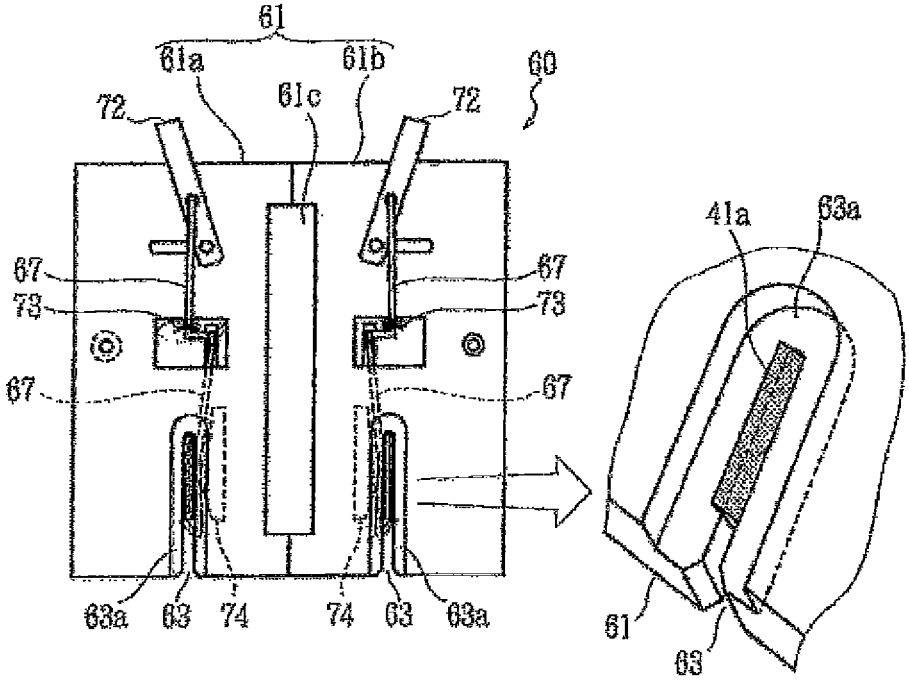
FIG. 16 is a front view showing a state in which two plate-shaped bodies of the tablet cutting blade replacement jig shown in FIG. 4 are opened to expose their inward surfaces.

As shown in FIGS. 14 and 15, the jig main body 61 includes: two plate-shaped bodies 61*a* and 61*b* that are substantially plane-symmetric openable/closable members; and a joint member 61*c* for joining the plate-shaped bodies 61*a* and 61*b*. The jig main body 61 is formed such that the two plate-shaped bodies 61*a* and 61*b* can open and close like a hinge with the joint portion between the joint member 61*c* and the plate-shaped bodies 61*a* and 61*b* serving as a pivot. The two plate-shaped bodies 61*a* and 61*b* are fastened with the locking screw 71 on their unjoined side, i.e., the side opposite to the joint member 61*c*, whereby a closed state is maintained. The jig main body 61 is configured such that the plate-shaped bodies 61*a* and 61*b* are allowed to open and close by loosening the locking screw 71 as shown in FIG. 16.

One of the recesses 62 described above is formed on an end surface of the joint member 61*c* that is farther from the plate-shaped bodies 61*a* and 61*b* in the closed state, and the other is such that its halves are formed on the unjoined end surfaces of the plate-shaped bodies 61*a* and 61*b*. In other words, the two plate-shaped bodies 61*a* and 61*b* are combined to form one recess 62. Specifically, the recesses 62 appear on the opposite lateral end surfaces of the jig main body 61 in the closed state in which the two plate-shaped bodies 61*a* and 61*b* are closed.

In this embodiment, the openable/closable members are the plate-shaped bodies 61*a* and 61*b*. However, any openable/closable members may be used so long as they can open and close with their joint portion with the joint member 61*c* serving as a pivot, and the openable/closable members may have any shape other than a plate shape.

Notches 63 into which the cutting edge portions 41*a* of the tablet cutting blades 41 can be inserted are formed on the lower ends of the plate-shaped bodies 61*a* and 61*b*, i.e., their ends that are first inserted when the blade replacement jig 60 is attached to the main body 24. In the blade replacement jig 60, a holding state in which the tablet cutting blades 41 are retained in the blade holders 64 is formed when retaining members 67 are raised with hooking ends 68 of the retaining members 67 hooked on the cutting edge portions 41*a* inserted into the notches 63. The number of blade holders 64 provided is two because the two plate-shaped bodies 61*a* and 61*b* are provided. Specifically, the blade holders 64 include: a blade holder attached to the front plate-shaped body 61*a* of the jig main body 61 in order to attach and detach the tablet cutting blade 41 shown in FIG. 3 that is on the front side of the main body 24; and a blade holder attached to the rear plate-shaped body 61*b* of the jig main body 61 in order to attach and detach the unillustrated tablet cutting blade 41 on the rear side.

When the tablet cutting blades 41 are held in the blade holders 64, the two plate-shaped bodies 61*a* and 61*b* hold the cutting edge portions 41*a* within the notches 63 such that the cutting edges of the tablet cutting blades 41 are oriented toward the inward surfaces (mating surfaces) of the two plate-shaped bodies 61*a* and 61*b* in their closed state with the blade bases 41*b* protruding outward. As shown in an enlarged view in FIG. 16, on the inward surface of each of the plate-shaped bodies 61*a* and 61*b*, the periphery of the notch 63 is slightly carved to form a carved portion 63*a*. These carved portions 63*a* allow the foremost portions of the retained cutting edge portions 41*a*, i.e., the cutting edges of the tablet cutting blades 41, to be exposed such that they can be visually checked and cleaned within the carved portions 63*a* on the inward surfaces.

The tablet cutting blades 41 with the cutting edge portions 41*a* inserted and fitted into the notches 63 of the plate-shaped bodies 61*a* and 61*b* are held in the blade replacement jig 60 such that the protrusions 41*d* serving as the sliding engagement portions are parallel to the recesses 62 of the jig main body 61 that serve as the sliding engagement portions. Therefore, as described above, when the jig main body 61 in the closed state is slidingly engaged with the support members 28, the opposed blades 41 and 41 (tablet cutting blades) are slidingly engaged with the front blade moving member 43 and the rear blade moving member 44. Both the plate-shaped bodies 61*a* and 61*b* have the notches 63 formed such that the tablet cutting blades 41 can be inserted thereinto while being slidable with respect to the blade moving members 43 and 44.

Each of the plate-shaped bodies 61*a* and 61*b* has: a retaining member 67 having a hooking end 68 disposed near the blade holder 64 and the notch 63 described above; and an operating member 72 that is manually operated to switch between a retention maintained state (maintenance of retention) that is a blade retention maintained state described later in which a tablet cutting blade 41 is retained by the retaining member 67 and a retention released state (release of retention) that is a blade retention released state. Each of the plate-shaped bodies 61*a* and 61*b* includes: an urging member 73 that assists maintenance of the state switched by the operating member 72 even though the switched state is the retention maintained state or the retention released state; and a guide 74 that guides the hooking end 68 from a position for the retention maintained state to a position for the retention released state and vice versa during switching by the operating member 72.

A description will next be given of the action and structure of each of the retaining member 67, the operating member 72, the urging member 73, and the guide 74 and the cooperation of these members.

The retaining member 67 is a member produced by bending a wire-shaped thin elastic body, and an upper end portion of the retaining member 67 is engaged with a central portion of the operating member 72. A lower end portion of the retaining member 67 is bent at an acute angle to form the hooking end 68. An intermediate portion of the retaining member 67 that is located between the upper and lower end portions includes a bent portion having a crank shape, i.e., part of the intermediate portion is bent twice at substantially right angles. The bent portion abuts against the lower end of the urging member 73 attached to the intermediate portion. This contributes to retention of the urging member 73, and the action of the urging member 73 allows the length of the retaining member 67 from the upper end to the lower end to exhibit appropriate stretchability necessary for retention of the tablet cutting blade 41. Specifically, the intermediate portion of the retaining member 67 is urged downward by the urging member 73. Therefore, in the retention maintained state in which the holding state where the tablet cutting blade 41 is held is maintained, the retaining member 67 is raised, and in the retention released state in which the holding state can be released, the retaining member 67 is lowered, so that the retaining member 67 exhibits stretchability. This will be described later in more detail.

The operating member 72 is produced by bending the upper end of a thin plate-shaped body having a flat cord shape and includes a sliding pin 72*a* attached to substantially the center of the operating member 72 and a sliding pin 72*b* attached to the lower end thereof. The sliding pin 72*a* is slidably inserted into a vertically elongated through hole of the plate-shaped body 61*a* or 61*b*. The sliding pin 72*b* is slidably inserted into a horizontally elongated through hole of the plate-shaped body 61*a* or 61*b* that is formed below the above-described vertically elongated through hole and is attached to the plate-shaped body 61*a* or 61*b* with the upper end of the sliding pin 72*b* protruding upward. The horizontally elongated through hole is not symmetric with respect to the vertically elongated through hole, and the horizontally elongated through hole is positioned unevenly to the right side which is a blade retention released side. Specifically, the right end of the horizontally elongated through hole is farther from the vertically elongated through hole than the left end. Therefore, when the upper end of the operating member 72 is manually shifted to the left, i.e., to the blade retention released side, as shown in FIG. 14, the sliding pin 72*b* moves to the right, and the operating member 72 is largely inclined, so that the sliding pin 72*a* is lowered to a lower position in the vertically elongated through hole.

When the upper end of the operating member 72 is shifted to the right, i.e., to the blade retention maintained side, as shown in FIG. 15, the sliding pin 72*b* moves to the left, and the operating member 72 is inclined slightly, so that the sliding pin 72*a* remains at a relatively upper position in the vertically elongated through hole.

In the configuration described above, the operating member 72 is manually operated to switch between the retention maintained state (maintenance of retention) and the retention released state (release of retention).

In this embodiment, each urging member 73 is an elastic body such as a coil spring. The urging member 73 has a spring sensitivity smaller than the lengthwise spring sensitivity of the retaining member 67 and is shorter in length than the retaining member 67, and the upper end of the urging member 73 abuts against, for example, a step in the plate-shaped body 61*a* or 61*b*, so that the urging member 73 is always compressed. Since the urging member 73 is always compressed, the spring force caused by compression causes the retaining member 67 to be always urged downward.

Since the upper end of the retaining member 67 is engaged with the central portion of the operating member 72, an urging force acts on the operating member 72 in a direction that allows the inclination of the operating member 72 to be maximum both in the retention maintained state and the retention released state.

Specifically, in the blade replacement jig 60, each urging member 73 allows the retention maintained state to be maintained unchanged and the retention released state to be maintained unchanged.

Each guide 74 is a guiding member disposed adjacent to the notch 63 and is placed such that a lower portion of the retaining member 67 is located between the guide 74 and the notch 63 to guide the movement of the retaining member 67. A side surface of the guide 74 is curved so as to conform to the curve of the lower portion of the retaining member 67. When the retaining member 67 is lowered, the guide 74 guides the retaining member 67 such that its hooking end 68 moves in a direction away from the notch 63. When the retaining member 67 is raised, the guide 74 guides the retaining member 67 such that its hooking end 68 moves to a position above the notch 63.

Figure 17:
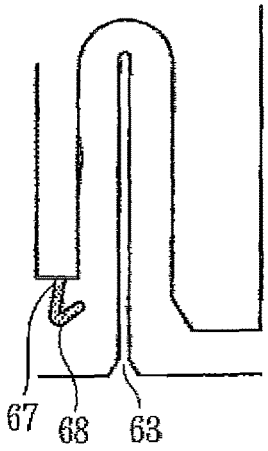
FIG. 17 is a front view showing the retention released state for a cutting edge portion of a tablet cutting blade of the tablet cutting blade replacement jig shown in FIG. 13.
Figure 18:
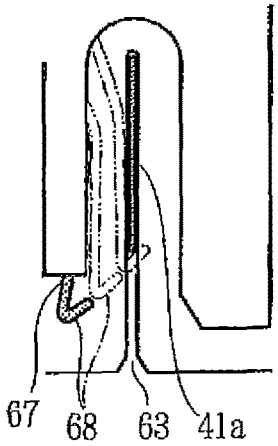
FIG. 18 is a front view showing an action when the retention released state for the cutting edge portion of the tablet cutting blade of the tablet cutting blade replacement jig shown in FIG. 17 is changed to the retention maintained state.

Therefore, when the operating member 72 is shifted to the retention released side, the blade replacement jig 60 enters the retention released state in which the cutting edge portion 41*a* can enter and leave the notch 63, as shown in FIG. 17. When the operating member 72 is shifted to the retention maintained side, the blade replacement jig 60 enters the retention maintained state in which the cutting edge portion 41*a* is caught and held in the notch 63, as shown in FIG. 18.

The modes of use and operations of the blade replacement jig 60 in Example 1 will be described with reference to the drawings.

A description will be given of the operation when the tablet cutting blades 41 are attached to and detached from the blade replacement jig 60, the operation when the tablet cutting blades 41 are transferred between the blade replacement jig 60 and the tablet splitting apparatus 20, and the operation when the cutting edges of the tablet cutting blades 41 are visually checked and cleaned with the tablet cutting blades 41 held in the blade replacement jig 60. The blade replacement jig 60 is used for the tablet splitting apparatus 20 when no tablet is cut, so that the description of the tablet cutting operation etc. of the tablet splitting apparatus 20 will be appropriately omitted.

The tablet cutting blades 41 can be attached to and detached from the blade replacement jig 60 separately from the operation of the tablet splitting apparatus 20 without disturbing the operation of the tablet splitting apparatus 20.

When the tablet cutting blades 41 are attached to an empty blade replacement jig 60 with no tablet cutting blades 41 attached thereto, the two plate-shaped bodies 61*a* and 61*b* of the blade replacement jig 60 are closed and fixed using the locking screw 71, and the operating members 72 and 72 are manually shifted to the retention released side. As described above, in the retention released state, the retaining members 67 of the plate-shaped bodies 61*a* and 61*b* are lowered, and the hooking ends 68 are spaced apart from the notches 63. The retention released state is stably maintained due to the force of the urging members 73 unless the operating members 72 are operated.

Then, while the safe blade base 41*b* of a tablet cutting blade 41 is hand-held, its cutting edge portion 41*a* is inserted into the notch 63 of one of the plate-shaped bodies 61*a* and 61*b*, e.g., the plate-shaped body 61*a*. Then the unsafe cutting edge of the tablet cutting blade 41 is spontaneously oriented toward the inward surface of the plate-shaped body 61*a* and accommodated in the carved portion 63*a*. Then the operating member 72 of the plate-shaped body 61*a* is shifted to the retention maintained side.

Figure 19:
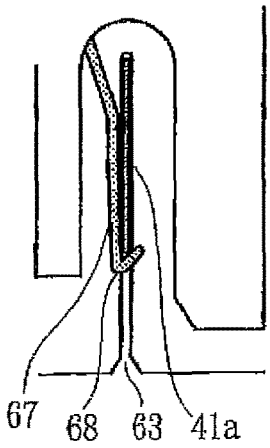
FIG. 19 is a front view showing the retention maintained state for the cutting edge portion of the tablet cutting blade of the tablet cutting blade replacement jig shown in FIG. 17.

As a result of the above operation, the hooking end 68 moves to the position of the notch 63 as shown in FIG. 18, and the retaining member 67 is raised. Then the hooking end 68 is engaged with the lower end of the cutting edge portion 41*a* of the tablet cutting blade 41, and the cutting edge portion 41*a* is moved upward to an upper portion of the notch 63. In this case, a holding state in which the tablet cutting blade 41 is held in the blade holder 64 is formed as shown in FIG. 19. A similar operation is performed for the other one of the plate-shaped bodies 61*a* and 61*b*, i.e., the plate-shaped body 61*b*, to form the holding state.

When the tablet cutting blades 41 are detached from the blade replacement jig 60, the reverse operation is performed.

Specifically, the operating members 72 are shifted from the retention maintained side to the retention released side. Then the hooking ends 68 move so as to be spaced apart from the notches 63, and the retaining members 67 are lowered, whereby the retention released state is formed.

A description will be given of transfer of the tablet cutting blades 41 between the blade replacement jig 60 and the tablet splitting apparatus 20. For example, when the cutting edges of the opposed blades 41 and 41 of the tablet splitting apparatus 20 in use are worn, the opposed blades 41 and 41 are replaced. The replacement operation can be performed easily as follows. First, the holding mechanism 30 is detached from the tablet splitting apparatus 20, and an empty blade replacement jig 60 is inserted and withdrawn in place of the holding mechanism 30 to detach the old opposed blades 41 and 41 from the cutting mechanism 40. Next, a blade replacement jig 60 with new opposed blades 41 and 41 attached thereto is inserted and withdrawn to attach the new opposed blades 41 and 41 to the cutting mechanism 40. Finally, the holding mechanism 30 is returned.

When two or more blade replacement jigs 60 can be used, one blade replacement jig 60 is used as an empty jig for detachment. New tablet cutting blades 41 are attached to the other blade replacement jig 60 in the manner described above, and this blade replacement jig 60 is used for attachment. In this case, one tablet cutting blade 41 is attached to one of the two plate-shaped bodies 61*a* and 61*b* as needed, or two tablet cutting blades 41 are attached to the two plate-shaped bodies 61*a* and 61*b*. When the opposed blades 41 and 41 are attached in one operation, they are attached to both the two plate-shaped bodies 61*a* and 61*b*. When only one blade replacement jig 60 can be used, the blade replacement jig 60 with no blades is used for detachment. After the opposed blades 41 and 41 are detached from the tablet splitting apparatus 20, the old opposed blades 41 and 41 are replaced with new opposed blades 41 and 41, and this blade replacement jig 60 can be reused for attachment. In both cases, the same procedure is performed. Therefore, a description will be given of the case in which two blade replacement jigs 60 can be used.

After an empty blade replacement jig 60 for detachment and a blade replacement jig 60 for attachment that holds new tablet cutting blades 41 are prepared, the operator makes preparations for the tablet splitting apparatus 20. Specifically, automatic operations such as feed of tablets from the tablet cassette 21 to the main body 24 and cutting of the tablets by the cutting mechanism 40 are stopped by, for example, operating the operating unit 22. Then the tablet cassette 21 is manually detached from the tablet feeder base 27, and the lock 52 is released. Then the lid 51 is opened to expose the opening 54 of the main body 24. The upper end of the guiding member 31 is pulled by hand through the opening 54 to withdraw the holding mechanism 30. All the preparations are thereby completed.

Next, the operator holds the empty blade replacement jig 60 to insert the jig main body 61 of the tablet cutting blade replacement jig 60 into the support members 28 from which the guiding member 31 has been withdrawn. Then the cutting edge portions 41*a* and 41*a* of the tablet cutting blades (opposed blades) 41 and 41 with their blade bases 41*b* and 41*b* held by the blade moving members 43 and 44 of the tablet splitting apparatus 20 are contained in the notches 63 and 63 of the blade replacement jig 60.

Then the operator manually operates the operating members 72 and 72 to perform a switching operation for switching from the retention released state to the retention maintained state.

As a result of the switching operation, the blade replacement jig 60 enters a holding state in which the cutting edge portions 41*a* and 41*a* are captured in the notches 63 and 63 and the tablet cutting blades 41 and 41 are held in the blade holders 64 and 64.

When the operator withdraws the blade replacement jig 60 through the opening 54, the blade replacement jig 60 together with the tablet cutting blades 41 and 41 is taken out of the main body 24. The old opposed blades 41 and 41 are thereby detached from the tablet splitting apparatus 20. The old opposed blades 41 and 41 that remain attached to the blade replacement jig 60 are in a safe state and may be subjected to an appropriate subsequent step such as recycling or disposal. Alternatively, these old opposed blades 41 and 41 may be detached from the blade replacement jig 60 as described above, collected, and then subjected to the subsequent step.

Next, the operator holds the blade replacement jig 60 for attachment in which the new tablet cutting blades (opposed blades) 41 and 41 have been held and inserts the tablet cutting blade replacement jig 60 for attachment into the support members 28 of the tablet splitting apparatus 20 from which the tablet cutting blade replacement jig 60 for detachment has been withdrawn. The blade bases 41*b* of the new tablet cutting blades 41 and 41 with their cutting edge portions 41*a* held in the blade holders 64 and 64 are engaged with the blade moving members 43 and 44 and slide in a direction parallel to the direction of insertion, and the new tablet cutting blades 41 and 41 are thereby attached. Then the operator manually operates the operating members 72 and 72 to switch from the retention maintained state to the retention released state, and the hooking ends 68 of the retaining members 67 are thereby separated from the cutting edge portions 41*a* and 41*a* of the new tablet cutting blades 41 and 41, so that the capture by the blade holders 64 is released.

When the operator withdraws the blade replacement jig 60 through the opening 54 of the tablet splitting apparatus 20, the new tablet cutting blades 41 and 41 are disengaged from the blade replacement jig 60 and remain in the main body 24 as the opposed blades 41 and 41 attached to the blade moving members 43 and 44, and only the empty blade replacement jig 60 is taken out of the main body 24 of the tablet splitting apparatus 20. The attachment of the new opposed blades 41 and 41 is thereby completed. Then the operator attaches the holding mechanism 30 to the support members 28 of the tablet splitting apparatus 20 to return the holding mechanism 30 to a prescribed position in the main body 24, and the lid 51 is closed. Then the lock 52 is tightened, and the tablet cassette 21 is returned to the tablet feeder base 27. The blade replacement operation for the tablet splitting apparatus 20 is thereby completed, and the cutting of tablets can be immediately resumed.

Finally, a description will be given of the manner of visual inspection and cleaning of the cutting edges of the tablet cutting blades 41 with the tablet cutting blades 41 held in the blade replacement jig 60.

For example, after many tablets 10 are split using a single tablet splitting apparatus 20 or when the type of tablets 10 split using a single tablet splitting apparatus 20 is changed, it is necessary to visually check and clean the cutting edges of the opposed blades 41 and 41 attached to the tablet splitting apparatus 20.

In such a case, the opposed blades 41 and 41 are withdrawn from the tablet splitting apparatus 20 and then returned in the following manner.

The operator prepares one empty blade replacement jig 60. Then the opposed blades 41 and 41 are withdrawn from the tablet splitting apparatus 20 using the prepared tablet cutting blade replacement jig 60 in the same manner as that in the first half of the replacement of the opposed blades 41 and 41 described above. Then the operator loosens the locking screw 71 of the blade replacement jig 60 in the closed state and brings the two plate-shaped bodies 61*a* and 61*b* into an opened state.

Then the cutting edges of the opposed blades 41 and 41 are thereby exposed in the carved portions 63*a* on the inward surfaces of the two plate-shaped bodies 61*a* and 61*b*.

The operator visually checks the exposed cutting edges of the opposed blades 41 and 41 and cleans them if necessary. The opposed blades 41 and 41 are held in the plate-shaped bodies 61*a* and 61*b* even in the opened state. Therefore, the operator can perform the operation safely while hand-holding the plate-shaped bodies 61*a* and 61*b* that are larger and easier to hold than the tablet cutting blades (opposed blades) 41.

After completion of the inspection and cleaning of the cutting edges, the operator closes the plate-shaped bodies 61*a* and 61*b* (see FIG. 5(*b*)) and tightens the locking screw 71 to fix the plate-shaped bodies 61*a* and 61*b* in a closed state. Then the opposed blades 41 and 41 are returned to the tablet splitting apparatus 20 using the blade replacement jig 60 in the same manner as that in the second half of the replacement of the opposed blades 41 and 41 described above.

The inspection and cleaning of the opposed blades 41 and 41 can also be performed easily and safely in the manner described above.

[Others]

In the description of the above Example, the blade replacement jigs 60 are used to insert and withdraw the opposed blades 41 and 41 already attached to the tablet splitting apparatus 20. However, when the opposed blades 41 and 41 are attached to the tablet splitting apparatus 20 for the first time, the same operation as that in the second half of the procedure described above can be performed. When the opposed blades 41 and 41 are withdrawn from the tablet splitting apparatus 20 and no opposed blades 41 and 41 are attached, the same operation as that in the first half of the procedure described above can be performed.

When only one of the opposed blades 41 and 41, i.e., only one tablet cutting blade 41, is inserted and withdrawn, the above-described procedure can be performed only for a corresponding one of the plate-shaped bodies 61*a* and 61*b*.

REFERENCE SIGNS LIST

10 tablet, 11 cut tablet piece, cut piece, 20 tablet splitting apparatus, 21 tablet cassette, 22 operating unit, control unit, 24 main body (housing), 25 receiving unit, transit unit, 27 tablet feeder base, 28 support member, 28*a* sliding engagement portion (protrusion), 30 holding mechanism, 31 falling tablet guiding member (tablet guiding member), 32 tablet falling path, 33 cutting position, 34 receiving member, 35 slit, 36 fixed cover plate, 37 groove depth defining member, 38 sliding engagement portion (recess), 40 cutting member (cutting mechanism), 41 tablet cutting blade (one of opposed blades), 41*a* cutting edge portion, 41*b* blade base, 41*c* tapered portion, 41*d* sliding engagement portion (protrusion), 41*e* sliding engagement portion (recess), 43 blade moving member (front blade moving member), 44 blade moving member (rear blade moving member), 51 lid, 52 lock, 52 hinge, 53 hinge, 54 opening, tablet cutting blade replacement jig (blade replacement jig), 61 jig main body, 61*a* plate-shaped body (front), 61*b* plate-shaped body (rear), 61*c* joint member (hinge), 62 attachment-detachment portion (sliding engagement portion) (recess), 63 holding portion (notch), 63*a* carved portion, blade holder, 65 fixing member, 66 sliding engagement portion (protrusion), 67 retaining member, 68 hooking end, locking screw, 72 operating member, 72*a* sliding pin, 72*b* sliding pin, 73 urging member (spring, elastic body), guide

The invention claimed is:

1. A tablet cutting blade replacement jig used to assist a tablet cutting blade attaching/detaching operation for a tablet splitting apparatus, the tablet splitting apparatus being configured to allow a plate-shaped falling tablet guiding member having a tablet falling path formed therein to be slidingly engaged with and disengaged from a support member for the falling tablet guiding member and to allow tablet cutting blades to be slidingly engaged with and disengaged from blade moving members for holding the tablet cutting blades with a direction of sliding of the tablet cutting blades being parallel to a direction of sliding of the falling tablet guiding member, the tablet splitting apparatus including a housing that accommodates the support member and the blade moving members, the housing having an opening that allows the falling tablet guiding member and the tablet cutting blades to pass therethrough simultaneously, the opening being formed ahead of the support member and the blade moving members in the directions of sliding, the tablet cutting blade replacement jig comprising:

a jig main body including at least one plate shaped body having a notch that is formed so as to allow the tablet cutting blades to be inserted thereinto with the tablet cutting blades being slidable with respect to the blade moving members, the jig main body being capable of being slidingly engaged with and disengaged from the support member in place of the falling tablet guiding member;

blade holders for retaining the tablet cutting blades within the notch;

operating members that are manually operated to switch between maintenance and release of retention of the tablet cutting blades; and urging members for maintaining a state of the operating members after switching even though the state is on a retention maintained side or is on a retention released side.

2. The tablet cutting blade replacement jig according to claim 1, wherein the at least one plate-shaped body comprises two plate-shaped bodies that are disposed in the jig main body so as to be openable and closable, and the tablet cutting blades are held in the plate-shaped bodies with cutting edges of the tablet cutting blades oriented toward inward surfaces of the two plate-shaped bodies in a closed state.

3. A tablet cutting blade replacement jig comprising:

a holder for holding a cutting member including a blade that moves into and out of a falling path for a tablet and cuts the tablet when the blade enters the falling path;

an attachment-detachment portion attached to and detached from a support member in place of a tablet guiding member that forms the falling path, the tablet guiding member being configured to slide along the support member when the tablet guiding member is attached to and detached from a main body of a tablet splitting apparatus; and an operating member for setting one of a retention maintained state in which a holding state where the cutting member is held in the holder is maintained and a retention released state in which the holding state is releasable;

wherein the attachment-detachment portion slides along the support member in a direction parallel to a direction of sliding of the tablet guiding member along the support member and is thereby attached to and detached from the support member, wherein the holder receives and releases the cutting member in the direction parallel to the direction of sliding of the tablet guiding member;

wherein, by attaching the attachment-detachment portion to the support member while the holding state is maintained, setting the retention released state using the operating member, and then detaching the attachment-detachment portion from the support member, the cutting member is attached to the main body of the tablet splitting apparatus, and wherein, by attaching the attachment-detachment portion to the support member, setting the retention maintained state using the operating member while the holding state is maintained, and then detaching the attachment-detachment portion from the support member, the cutting member is detached from the main body of the tablet splitting apparatus.

4. The tablet cutting blade replacement jig according to claim 3, further comprising an urging member that allows the retention maintained state to be maintained unchanged and the retention released state to be maintained unchanged.

* * * * *